US012624855B2

(12) United States Patent
Huynh-Quan-Trung et al.

(10) Patent No.: US 12,624,855 B2
(45) Date of Patent: May 12, 2026

(54) HEATING, VENTILATING AND AIR CONDITIONING (HVAC) SENSOR DEVICE

(71) Applicant: BELIMO HOLDING AG, Hinwil (CH)

(72) Inventors: Henri Huynh-Quan-Trung, Aulnay sous-bois (FR); Robert Wueest, Zürich (CH); Maik Hoffmann, Grossröhrsdorf (DE)

(73) Assignee: BELIMO HOLDING AG, Hinwil (CH)

( * ) Notice: Subject to any disclaimer, the term of this patent is extended or adjusted under 35 U.S.C. 154(b) by 256 days.

(21) Appl. No.: 18/285,728

(22) PCT Filed: Apr. 12, 2022

(86) PCT No.: PCT/EP2022/059751

§ 371 (c)(1),
(2) Date: Oct. 5, 2023

(87) PCT Pub. No.: WO2022/223372

PCT Pub. Date: Oct. 27, 2022

(65) Prior Publication Data

US 2024/0191896 A1 Jun. 13, 2024

(30) Foreign Application Priority Data

Apr. 22, 2021 (CH) ..... 00431/21

(51) Int. Cl.
*F24F 11/32* (2018.01)
*F24F 11/49* (2018.01)
(Continued)

(52) U.S. Cl.
CPC ..... *F24F 11/49* (2018.01); *F24F 11/32* (2018.01); *F24F 2110/10* (2018.01);
(Continued)

(58) Field of Classification Search
CPC ..... F24F 2140/30; F25B 2313/0276; F25B 2700/11
See application file for complete search history.

(56) References Cited

U.S. PATENT DOCUMENTS 3,627,030 A * 12/1971 Lorenz ..... F24F 11/30 165/221
4,210,278 A 7/1980 Obler
(Continued)

FOREIGN PATENT DOCUMENTS

AU 2016100873 A4 7/2016
WO 2011/088270 A2 7/2011

OTHER PUBLICATIONS

Swiss Search Report for CH 4312021 dated Aug. 13, 2021.
(Continued)

*Primary Examiner* — Jerry-Daryl Fletcher
*Assistant Examiner* — Daniel C Comings
(74) *Attorney, Agent, or Firm* — Sughrue Mion, PLLC

(57) ABSTRACT

A heating, ventilating and air conditioning (HVAC) sensor device includes a control signal input for receiving, from an HVAC controller, a control signal for controlling a HVAC actuator, a control signal output for transmitting a control signal to the HVAC actuator; and an electronic circuit, which receives a sensor signal indicative of condensation and/or indicative of relative humidity; and passes through the control signal to the control signal output in response to the sensor signal indicative of condensation and/or indicative of relative humidity being within defined ranges, or overwrites the control signal received at the control signal input with a control reference value and outputs the overwritten control signal at the control signal output in response to the sensor signal being outside the defined ranges. The control reference value causes the HVAC actuator to move an actuated
(Continued)

part to a safety position which reduces and/or prevents formation of condensation.

18 Claims, 12 Drawing Sheets

(51) Int. Cl.
*F24F 110/10* (2018.01)
*F24F 110/20* (2018.01)
*F24F 140/30* (2018.01)

(52) U.S. Cl.
CPC ..... *F24F 2110/20* (2018.01); *F24F 2140/30* (2018.01); *F25B 2700/11* (2013.01)

(56) References Cited

U.S. PATENT DOCUMENTS

| | | | | |
|---|---|---|---|---|
| 4,971,610 | A | 11/1990 | Henderson | |
| 6,070,110 | A * | 5/2000 | Shah | G05D 22/02 165/238 |
| 2008/0078842 | A1 * | 4/2008 | MacDonald | F24F 11/88 236/44 R |
| 2015/0369508 | A1 | 12/2015 | Rosen | |
| 2021/0010683 | A1 | 1/2021 | Bessette et al. | |

OTHER PUBLICATIONS

International Search Report for PCT/EP2022/059751 dated Jul. 18, 2022.
Written Opinion for PCT/EP2022/059751 dated Jul. 18, 2022.

* cited by examiner

HEATING, VENTILATING AND AIR CONDITIONING (HVAC) SENSOR DEVICE

CROSS REFERENCE TO RELATED APPLICATIONS

This application is a National Stage of International Application No. PCT/EP2022/059751 filed Apr. 12, 2022, which is based on and claims priority to Swiss Patent Application No. 00431/21 filed Apr. 22, 2021, the contents of each of which being herein incorporated by reference in their entireties.

FIELD OF THE INVENTION

The present invention relates to a heating, ventilating and air conditioning (HVAC) sensor device. The present invention further relates to an HVAC system comprising one or more HVAC sensor devices, a controller device and one or more HVAC actuators configured to actuate one or more actuated parts. The present invention further relates to a method of operating an HVAC system.

BACKGROUND OF THE INVENTION

In the field of Heating, Ventilating and Air Conditioning, HVAC systems typically comprise a fluid transportation system connected to a heat exchanger arranged such as to be able to transfer thermal energy to or from the environment by means of a fluid circulating in said fluid transportation system.

In order to be able to regulate the flow of fluid to/from the heat exchanger, the heat exchanger is connected to the fluid transportation system via one or more actuated parts, such as valves and dampers. The actuated parts are mechanically controlled by HVAC actuators, including motorized HVAC actuators coupled to the actuated part. In the field of HVAC, HVAC actuators typically comprise an electric motor, coupled (through gears and/or other mechanical coupling), to the actuated part.

HVAC systems commonly comprise an HVAC controller configured to generate control signal(s) for operating the HVAC actuator(s). In typical HVAC applications, the HVAC controller(s) generate the control signals for the HVAC actuators according to various control algorithms (e.g. with regards to differential pressure, room temperature, flow of energy, etc.) to thereby actuate the actuators, such as to open and close an orifice of a valve or damper to regulate the flow of fluid to and from heat exchanger(s).

It is an important aspect in the field of Heating, Ventilating and Air Conditioning HVAC to operate the HVAC system in view of environmental variable(s) of the environment the HVAC system is installed in. Such environmental variables are measured by corresponding sensors arranged in the controlled environment, for example in the proximity of the heat exchanger(s) and/or the fluid transportation system to/from such heat exchanger(s). In particular, condensation management is an important aspect in the field of Heating, Ventilating and Air Conditioning HVAC to prevent discomfort, damage or improper operation due to condensation on components of the HVAC system and/or surfaces of the environment where the HVAC system is installed.

A known method for operating an HVAC system in view of environmental variable(s) is to communicatively connect sensors for the measurement of environmental variables to the HVAC controller(s) and to configure the HVAC controller(s) to generate the control signal(s) for operating the HVAC actuator(s) considering sensor signal(s) indicative of the one or more environmental variable(s).

However, there are certain use cases when communicatively connecting the sensors arranged in the controlled environment (in the proximity of the heat exchanger(s) and/or the fluid transportation system) is not possible, disadvantageous and/or economically/logistically not preferred.

A first use case, when communicatively connecting the sensors of environmental variables to the HVAC controller(s) is not desirable—is related to upgrading/retrofitting of installations not provided with sensors of environmental variables.

A further use case, when communicatively connecting the sensors of environmental variables to the HVAC controller(s) is not desirable—is when HVAC controller(s) of an HVAC system are not suitable and/or not configured to be connected to such sensors and/or not configured to process signals of such sensors.

An even further use case, when communicatively connecting the sensors of environmental variables to the HVAC controller(s) is not desirable—is when there is a significant distance between the controlled environment (where the sensors are to be located) and the HVAC controller(s). In such use cases, providing a data communication between the HVAC controllers and the sensors of environmental variables might require additional wiring infrastructure and/or additional radio communication equipment being installed, both of which might not be logistically or economically feasible. Furthermore, additional radio communication equipment might not even be possible, for example in environments where radio communication is to be reduced to a minimum due to sensitive equipment or due to security/privacy concerns.

SUMMARY OF THE INVENTION

It is an object of embodiments disclosed herein to provide a solution that—at least partially—addresses the above-identified use-cases, providing a feasible solution to operate an HVAC system in view of environmental variable(s).

In particular, it is an object of embodiments disclosed herein to provide a solution that enables operation of an HVAC systems in view of condensation in the HVAC system which overcomes at least a part of the disadvantages of known solutions which rely on communicative connection(s) from sensors located in a proximity of HVAC devices to HVAC controller(s).

In particular, it is a further object of embodiments disclosed herein to provide a retrofit solution to existing HVAC systems that enables operation of the retrofitted HVAC system in view of condensation in the HVAC system, without the need to exchange/adapt/or even reprogram existing HVAC controller(s) not configured to operate in view of the respective environmental variable.

According to embodiments of the present disclosure, this object is addressed by an HVAC sensor device to be arranged between an HVAC controller and an HVAC actuator, in particular between a control interface of the HVAC controller and a communication interface of the HVAC actuator. The sensor device comprises a control signal input, a control signal output and an electronic circuit. The control signal input is configured for receiving control signal(s) for controlling one or more HVAC actuator(s) from an HVAC controller. The control signal output is configured for transmitting control signal(s) for controlling the HVAC actuator(s) to the HVAC actuator(s).

The electronic circuit is configured to receive a sensor signal(s) indicative of condensation and/or relative humidity in the HVAC system. The electronic circuit then compares the sensor signal(s) indicative of condensation and/or relative humidity in the HVAC system with respective defined range(s).

The electronic circuit is further configured to pass through (unaltered) the control signal(s) received at the control signal input to the control signal output if the sensor signal(s) indicative of condensation and/or relative humidity is within a defined range(s).

The electronic circuit is further configured to overwrite the control signal(s) received at the control signal input with a control reference value and output the overwritten control signal(s) at the control signal output if the sensor signal(s) indicative of condensation and/or relative humidity is outside the defined range.

According to embodiments of the present disclosure, this object is further addressed by a method of operating an HVAC system comprising the steps of: receiving from an HVAC controller, at a control signal input of an HVAC sensor device, of control signal(s) for controlling one or more HVAC actuator(s); receiving, by an electronic circuit of the HVAC sensor device, of sensor signal(s) indicative of condensation and/or relative humidity in the HVAC system; comparing the signal(s) indicative of condensation and/or relative humidity in the HVAC system with a defined range(s); passing through the control signal(s) received at the control signal input to the control signal output if the sensor signal(s) indicative of condensation and/or relative humidity is within the defined range(s); and overwriting the control signal(s) received at the control signal input with a control reference value and output the overwritten control signal(s) at the control signal output if the sensor signal(s) indicative of condensation and/or relative humidity is outside the defined range.

Embodiments according to the present disclosure are advantageous since the sensor device may be placed in the proximity of the HVAC actuators, hence communicative connections to the HVAC controller(s) unnecessary. Furthermore, embodiments according to the present disclosure are advantageous since the sensor devices may easily be provided to retrofit existing HVAC systems, by arranging the sensor devices between existing HVAC controller(s) and existing HVAC actuator(s) without the need to alter or even re-program any of these. Thereby, the functionality of existing HVAC systems may be extended in an effort- and cost-efficient manner by enabling the HVAC system to operate in view of environmental variables, such as condensation and/or relative humidity, which the HVAC system was not originally (before the retrofit according to embodiments of the present disclosure) able to consider.

According to embodiments of the present disclosure, one or more sensor(s) for the measurement of condensation and/or relative humidity in the HVAC system are comprised by or communicatively connected to the sensor device.

According to particular embodiments of the present disclosure, the sensor signal(s) is indicative of:

- condensation on a surface of a heat exchanger (80) fluidly connected to the one or more HVAC actuator(s) (10) and/or
- condensation on a surface of a fluid connection to or from the one or more HVAC actuator(s) (10); and/or
- temperature and relative humidity of a volume of air in the HVAC system (1) in order to detect whether the volume of air has reached its dew point.

It is a further object of particular embodiments disclosed herein to provide a solution that enables HVAC controller(s) to be aware of its control signals (to the HVAC actuator(s)) being overwritten—by sensor device(s) of the present disclosure. This further objective is addressed according to embodiments of the present disclosure in that the HVAC sensor device further comprises a feedback output for transmitting feedback signal(s) to the HVAC controller, wherein the electronic circuit is further configured to output a feedback reference value at the feedback output if the sensor signal(s) indicative of condensation and/or relative humidity is outside the defined range. This further objective is further addressed according to embodiments of the present disclosure in that the method of operating an HVAC system further comprises transmitting, at a feedback output of the HVAC sensor device, a feedback reference value to the HVAC controller if the sensor signal(s) indicative of condensation and/or relative humidity is outside the defined range.

It is a further object of particular embodiments disclosed herein to provide a solution that enables feedback signals generated by HVAC actuators to be available to HVAC controller(s) under normal operating conditions—that is when the control signals are not overwritten by the sensor device(s) of the present disclosure. This further objective is addressed according to embodiments of the present disclosure in that the HVAC sensor device further comprises a feedback input for receiving feedback signal(s) from the HVAC actuator(s), wherein the electronic circuit is further configured to pass through the feedback signal(s) received at the feedback input to the feedback output if the sensor signal(s) indicative of condensation and/or relative humidity is within a defined range(s). This further objective is further addressed according to embodiments of the present disclosure in that the method of operating an HVAC system further comprises receiving a feedback signal(s) from the HVAC actuator(s) at a feedback input of the HVAC sensor device; and passing through the feedback signal(s) received at the feedback input to the feedback output if the sensor signal(s) indicative of condensation and/or relative humidity is within a defined range(s).

By passing-through, respectively overwriting feedback signals from HVAC actuator(s) to the HVAC controller(s), the sensor device of the present disclosure enables transmission of feedback signals, which are indicative of condensation and/or relative humidity in the HVAC system being outside the defined range, using pre-existing feedback channels. Hence, the functionality of existing HVAC systems may be further extended without the need for additional connections (wired or wireless) between the HVAC actuator(s) and HVAC controller(s).

According to embodiments of the present disclosure, the control reference value and/or the feedback reference value is/are received by the HVAC sensor device using a reference input(s) respectively a feedback reference input(s).

Alternatively, or additionally—in order to reduce complexity, the electric circuit is further configured to derive the control reference value and/or the feedback reference value from the control signal(s) received at the control signal input. According to embodiments of the present disclosure, the control reference value is within a value range of the control signal.

It is a further object of particular embodiments disclosed herein to provide a solution that enables HVAC controller(s) to be aware of the values of condensation and/or relative humidity in the HVAC system as measured by the sensor device(s) of the present disclosure. This further objective is addressed according to embodiments of the present disclosure in that the HVAC sensor device further comprises a sensor signal output for transmitting the sensor signal(s) indicative of condensation and/or relative humidity in the HVAC system to the HVAC controller, wherein the electronic circuit is further configured to forward the sensor signal(s) at said sensor signal output. This further objective is further addressed according to embodiments of the present disclosure in that the method of operating an HVAC system further comprises forwarding, at a sensor signal output, the sensor signal(s) indicative of condensation and/or relative humidity in the HVAC system to the HVAC controller.

According to embodiments of the present disclosure, the control signal(s) is/are analogue signal(s), wherein the control reference value and/or the feedback reference value are pre-determined voltage/current values.

According to embodiments of the present disclosure, the control signal(s) is/are digital signal(s), wherein the control reference value and/or the feedback reference value are pre-determined digital values.

It is a further object of particular embodiments disclosed herein to provide a solution that ensures that the actuated part is moved into a safety position which reduces and/or prevents formation of condensation, such as a closed position of a valve under certain environmental conditions, such as condensation and/or relative humidity in the HVAC system. This further objective is addressed according to embodiments of the present disclosure in that HVAC sensor device is configured such as to overwrite the control signal(s) with a control reference value, which—when received by the actuator(s)—causes the HVAC actuator(s) to move an actuated part in a safety position which reduces and/or prevents formation of condensation, wherein the control reference value is within a value range of the control signal.

It is a further object of particular embodiments disclosed herein to provide a solution that allows extending the functionality of HVAC systems to operate in view of condensation and/or relative humidity within the HVAC system while minimizing the needs for electrical installation. According to embodiments of the present disclosure this further object is addressed in that the HVAC sensor device is configured to transfer at least a part of electrical power received at the control signal input to the control signal output and to power the electronic circuit using electrical power received at the control signal input. Additionally, the sensor device may be further configured to also power a sensor (for the measurement of condensation and/or relative humidity in the HVAC system) using at least a part of the electrical power received at the control signal input. This further objective is also addressed according to embodiments of the present disclosure in that the method of operating an HVAC system further comprises transferring at least a part of electrical power received at the control signal input to the control signal output and powering the electronic circuit of the HVAC sensor device and/or sensor(s) for the measurement of condensation and/or relative humidity in the HVAC system using at least a part of the electrical power received at the control signal input.

It is a further object of particular embodiments disclosed herein to provide an HVAC system operating in view of condensation and/or relative humidity in the HVAC system overcoming at least a part of the disadvantages of known solutions.

The above-identified objective is further addressed by an HVAC system comprising an HVAC controller, one or more HVAC actuator(s) and an HVAC sensor device according to one of the embodiments disclosed herein. The HVAC controller of the HVAC system is configured to generate control signal(s) for operating one or more HVAC actuator(s) at a control interface. The one or more HVAC actuator(s) comprise an electric motor configured to move an actuated part coupled to the electric motor, an electronic circuit connected to the electric motor, and a communication interface connected to the electronic circuit. The electronic circuit of the HVAC actuator(s) is configured to control the electric motor in accordance with control signals received via the communication interface.

The HVAC sensor device is arranged between the control interface of the HVAC controller and the communication interface of the HVAC actuator. The wording "arranged between the control interface of the HVAC controller and the communication interface of the HVAC actuator" is to be understood to relate to being arranged in the communication path between the control interface of the HVAC controller and the communication interface of the HVAC actuator.

A known particular application of HVAC systems comprises a 6-way flow regulator arranged between a heat exchanger and a fluid source of a first temperature and a fluid source of a second temperature. In particular, 6-way flow regulators are used in applications when the same heat exchanger is being used for both heating and cooling, the 6-way flow regulator being arranged to switch the heat exchanger's fluid input and return between a first respectively a second fluid circuit. 6-way flow regulators comprise a first fluid input; a second fluid input; a fluid output; a fluid return input; a first fluid return output; and a second fluid return output. Known 6-way flow regulators may be operated in a first operating mode, a second operating mode and a third operating mode. In the first operating mode, the 6-way flow regulator enables a flow of fluid from the first fluid input towards the fluid output and a flow of fluid from the fluid return input towards the first fluid return output. In the second operating mode, the 6-way flow regulator enables a flow of fluid from the second fluid input towards the fluid output and a flow of fluid from the fluid return input towards the second fluid return output. In the third operating mode, the 6-way flow regulator prevents passage of fluid between any of the first fluid input; the second fluid input (I2); the fluid output; the fluid return input; the first fluid return output and the second fluid return output.

It is an object of further embodiments of the present invention to enable an HVAC system comprising a 6-way flow regulator to operate in view of environmental conditions, such as condensation and/or relative humidity in the HVAC system, while avoiding at least part of the disadvantages associated with known solutions. According to embodiments of the present disclosure this further objective is addressed by an HVAC system having a 6-way flow regulator; an HVAC controller configured to generate control signal(s) for operating one or more HVAC actuator(s); and an HVAC sensor device according to one of the embodiment disclosed herein, wherein the HVAC actuator is configured to switch the 6-way flow regulator into the third operating mode upon receipt of the control reference value.

According to further embodiments, the HVAC system according to the present disclosure further comprises a heat exchanger and a sensor. A fluid input side of the heat exchanger is fluidly connected to the fluid output of the 6-way flow regulator and a fluid return side fluidly connected to the fluid return input of the 6-way flow regulator. The first fluid input of the 6-way flow regulator is fluidly connected to a fluid source of a first temperature and the second fluid input of the 6-way flow regulator is fluidly connected to a fluid source of a second temperature, the first temperature being different from the second temperature.

The sensor(s) is arranged to measure condensation on a surface of the heat exchanger and/or a fluid connection between the heat exchanger and the 6-way flow regulator. Additionally, or alternatively, the sensor(s) is arranged to measure the dew-point in a vicinity of the heat exchanger.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

The herein described disclosure will be more fully understood from the detailed description given herein below and the accompanying drawings which should not be considered limiting to the disclosure described in the appended claims. The drawings which show:

DETAILED DESCRIPTION

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
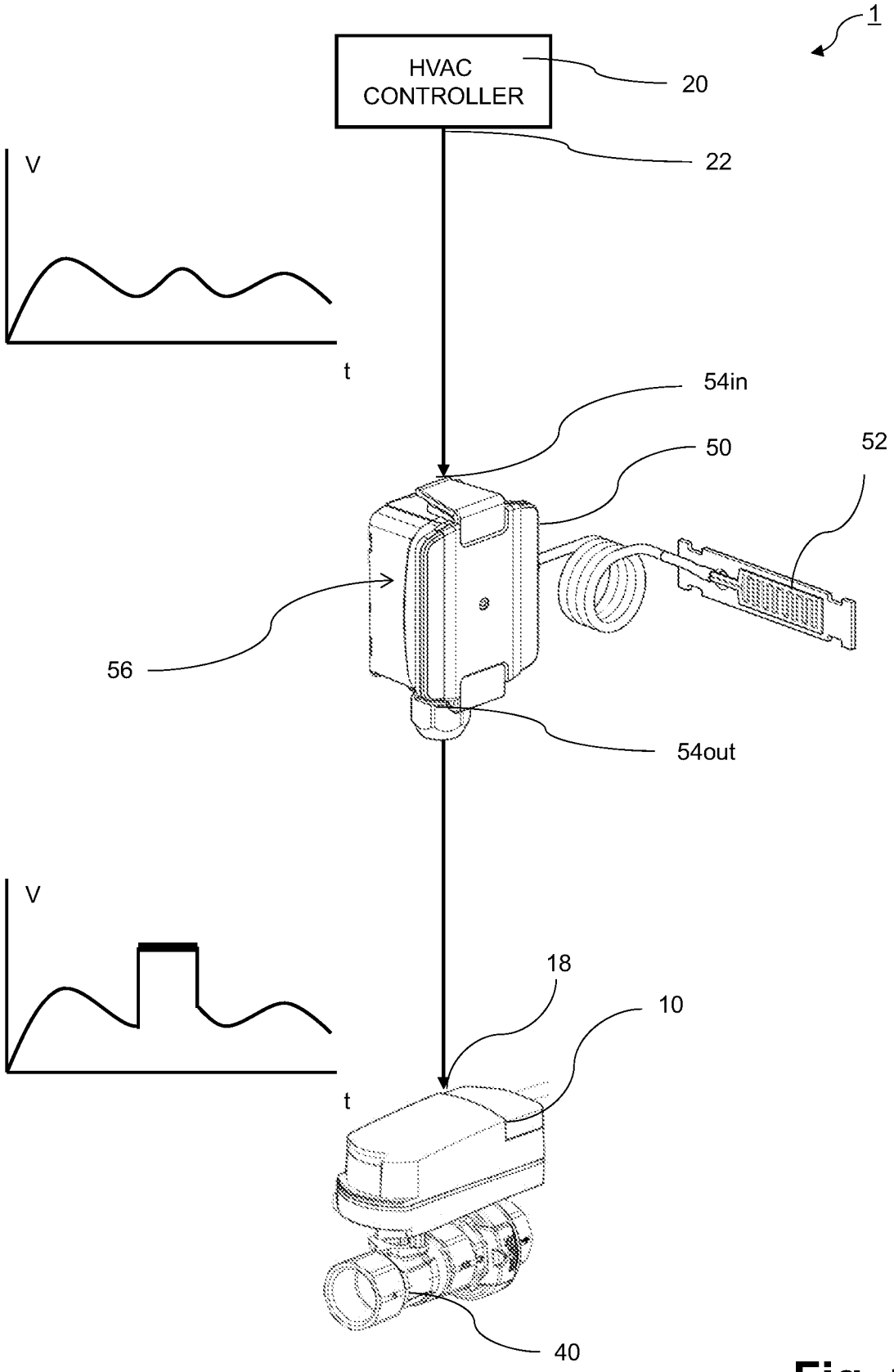
FIG. 1: a highly schematic illustration of an embodiment of an HVAC system comprising an HVAC sensor device arranged between an HVAC controller and an actuator for actuating an actuated part according to embodiments of the present disclosure.

FIG. 1 shows a highly schematic illustration of an embodiment of an HVAC system 1 comprising an HVAC sensor device 50 arranged between an HVAC controller 20 and an HVAC actuator 10 for actuating an actuated part 40 according to embodiments of the present disclosure. As illustrated, the HVAC sensor device 50 is arranged between a control interface 22 of the HVAC controller 20 and a communication interface 18 of the HVAC actuator 10. The sensor device 50 comprises a control signal input 54in, a control signal output 540out and an electronic circuit 56. The control signal input 54in is configured for receiving control signal(s) for controlling one or more HVAC actuator(s) 10 from an HVAC controller 20. The control signal output 54out is configured for transmitting control signal(s) for controlling the HVAC actuator(s) 10. The HVAC actuator 10 may comprise various regulating elements, such as—but not limited to—2, 3 or 6-way valves. According to particular embodiments disclosed herein, the regulating elements are pressure independent/pressure compensated regulating elements. According to embodiments of the present disclosure, the pressure independence/pressure compensation of the regulating elements is achieved electronically and/or mechanically.

Figure 2:
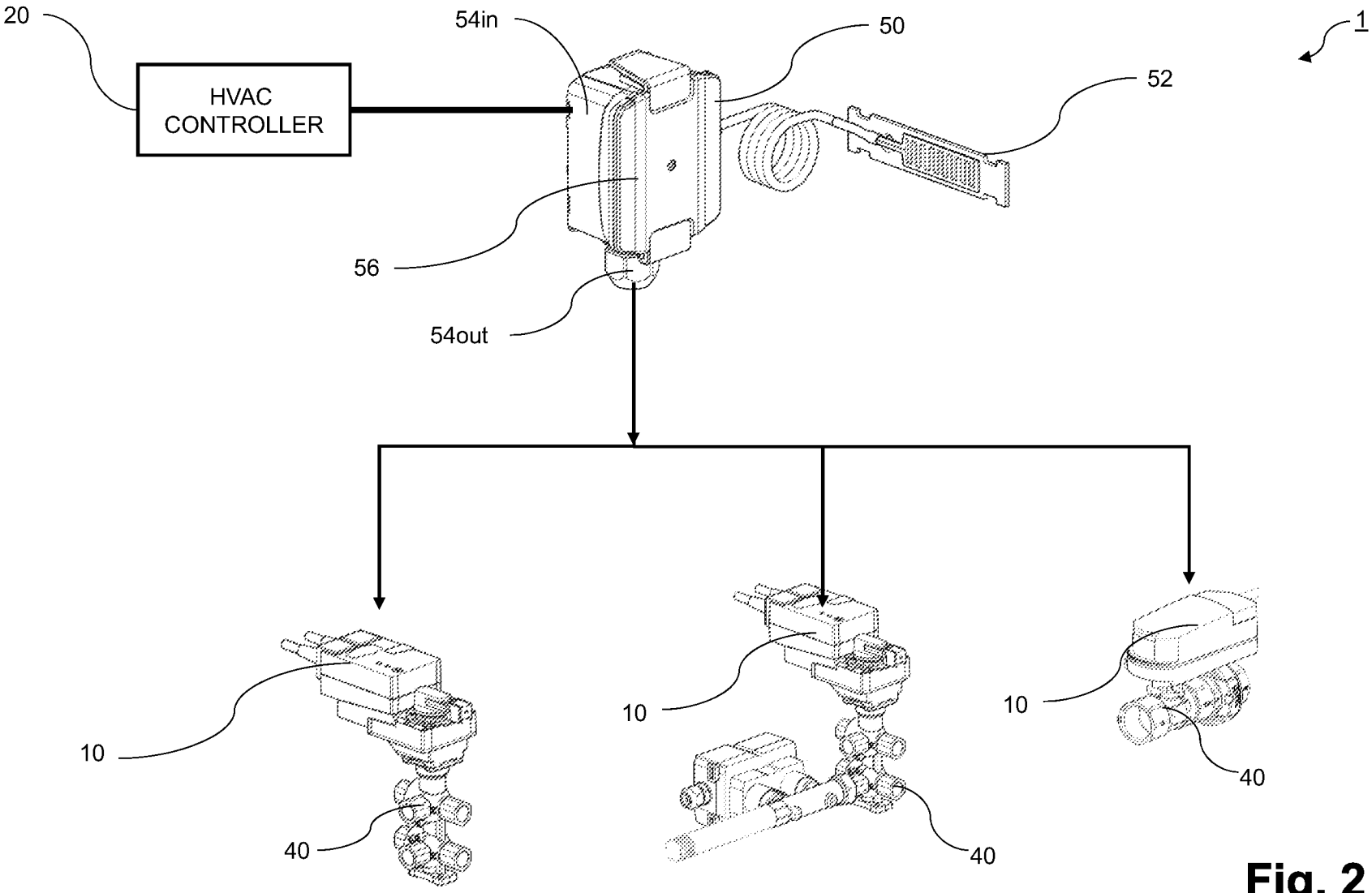
FIG. 2: a highly schematic illustration of a further embodiment of an HVAC system comprising an HVAC sensor device arranged between an HVAC controller and a plurality of HVAC actuators, each for actuating respective actuated parts according to embodiments of the present disclosure.

FIG. 2 shows a highly schematic illustration of a further embodiment of an HVAC system 1 comprising an HVAC sensor device 50 arranged between an HVAC controller 20 and a plurality of HVAC actuators 10, each for actuating respective actuated parts 40 according to embodiments of the present disclosure. According to embodiments of the present disclosure, one HVAC sensor device 50 is configured to pass through, respectively overwrite control signals to a plurality of HVAC actuators 10, each HVAC actuator 10 receiving a different, specific control signal, e.g. by means of a communication bus of the control signals.

Figure 3:
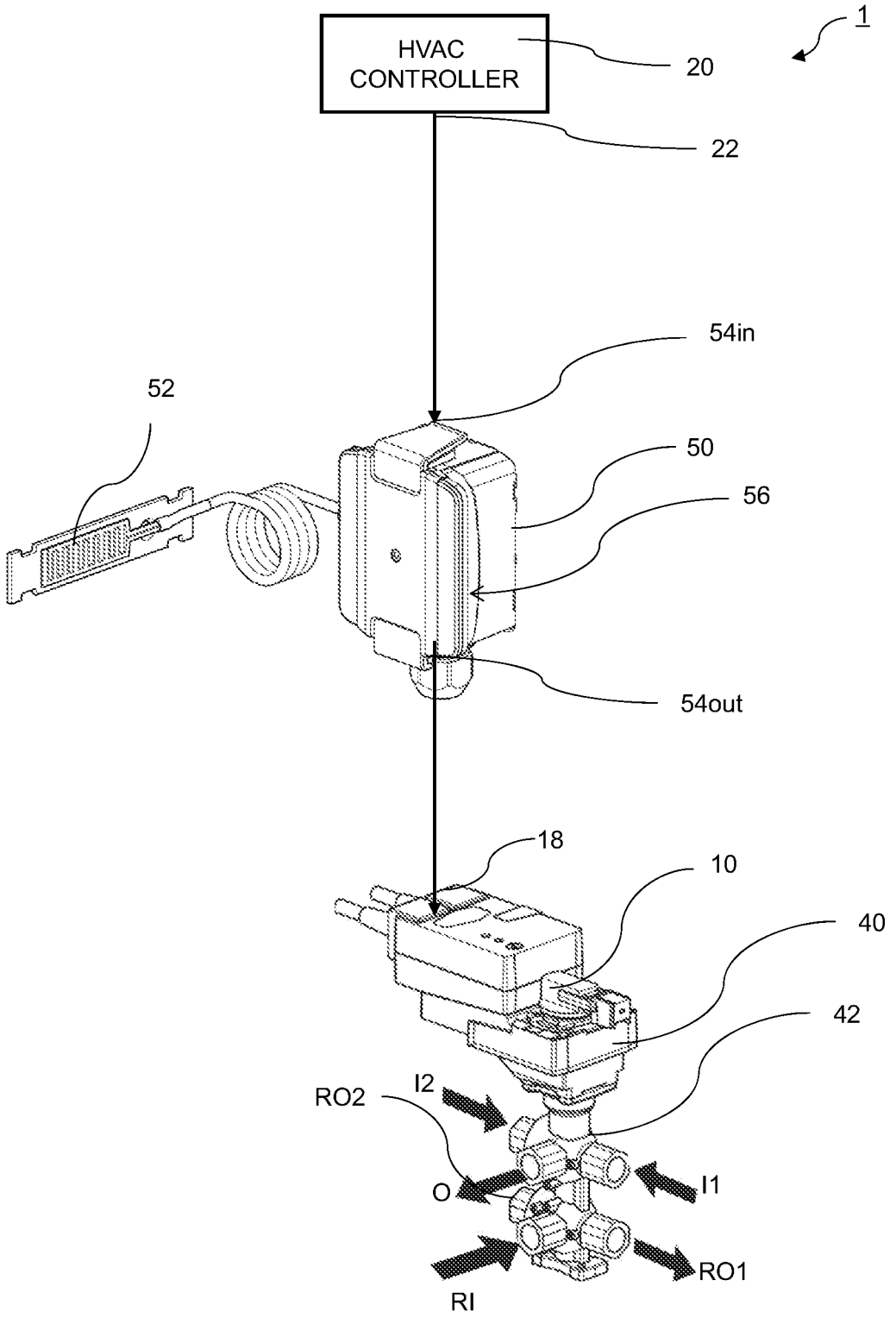
FIG. 3: a highly schematic illustration of a further embodiment of an HVAC system comprising an HVAC sensor device arranged between an HVAC controller and an HVAC actuator for controlling a 6-way flow regulator according to embodiments of the present disclosure.

Turning now to FIG. 3, a particular application of HVAC systems 1 shall be described which comprises a 6-way flow regulator 42 capable of switching between a first mode of operation (heating, e.g. at a 90° position of the valve) and a second mode of operation (cooling, e.g. at a 0° position of the valve) based on control signals from the HVAC controller 20. As illustrated, the 6-way flow regulator 42 comprises a first fluid input I1; a second fluid input I2; a fluid output O; a fluid return input RI; a first fluid return output RO1; and a second fluid return output RO2. The 6-way flow regulator 42 may be operated in a first operating mode, a second operating mode and a third operating mode. In the first operating mode, the 6-way flow regulator 42 enables a flow of fluid from the first fluid input I1 towards the fluid output O and a flow of fluid from the fluid return input RI towards the first fluid return output RO1. In the second operating mode, the 6-way flow regulator 42 enables a flow of fluid from the second fluid input I2 towards the fluid output O and a flow of fluid from the fluid return input RI towards the second fluid return output RO2. In the third operating mode, the 6-way flow regulator 42 prevents passage of fluid from first fluid input I1 or the second fluid input (I2) to the fluid output O.

The HVAC sensor device 50 of the present invention ensures that the 6-way flow regulator 42 is switched by the HVAC actuator 10 into a third mode of operation (closed position, e.g. at 45° angle of the valve) under certain environmental conditions, such as condensation and/or relative humidity in the HVAC system, by overwriting the control signals with a control reference value V1 (e.g. 6V), the HVAC actuator 10 being configured to switch the 6-way flow regulator 42 into the third operating mode (closed) upon receipt of the control reference value V1.

Figure 4A:
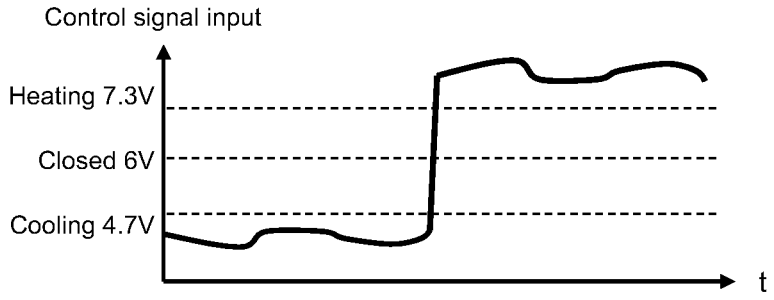
FIG. 4A: an illustrative diagram showing the control signal received at the control signal input.
Figure 4B:
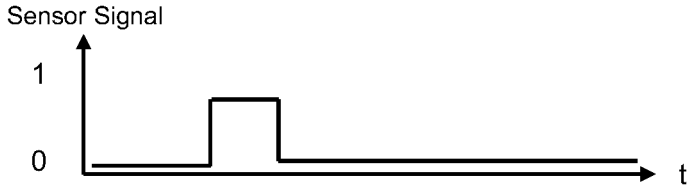
FIG. 4B: an illustrative diagram showing the sensor signal indicative of condensation in the HVAC system.
Figure 4C:
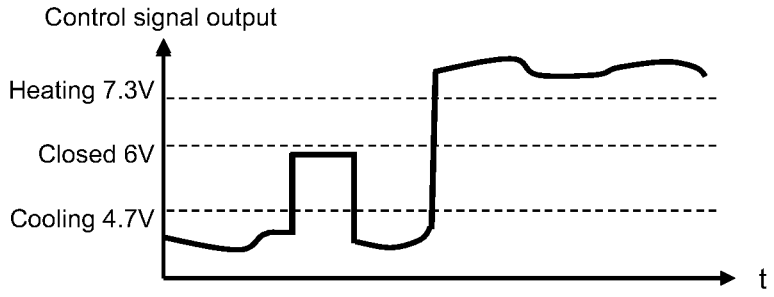
FIG. 4C: an illustrative diagram showing the control signal at the control signal output.

The sequence of FIGS. 4A to 4C shows the control signal input, the sensor signal indicative of condensation; and the control signal output, respectively, for the HVAC systems 1 of FIG. 3.

FIG. 4A shows an illustrative diagram of the control signal received at the control signal input 54in reflecting various operating states, namely cooling, closed and heating.

FIG. 4B shows an illustrative diagram of the sensor signal from the sensor 52 indicative of condensation and/or relative humidity in the HVAC system, shown here with binary values, 0 for lack of and 1 for the presence of condensation and/or a relative humidity above dew point in the HVAC system 1.

FIG. 4C shows an illustrative diagram of the control signal at the control signal output 54out as overwritten by the HVAC sensor device 50 of the present disclosure, wherein for the period when sensor signal(s) indicative of condensation and/or relative humidity is outside the defined range (in the depicted example "1"), the control signal has been overwritten with a control reference value V1 (in the depicted example 6V).

Figure 5:
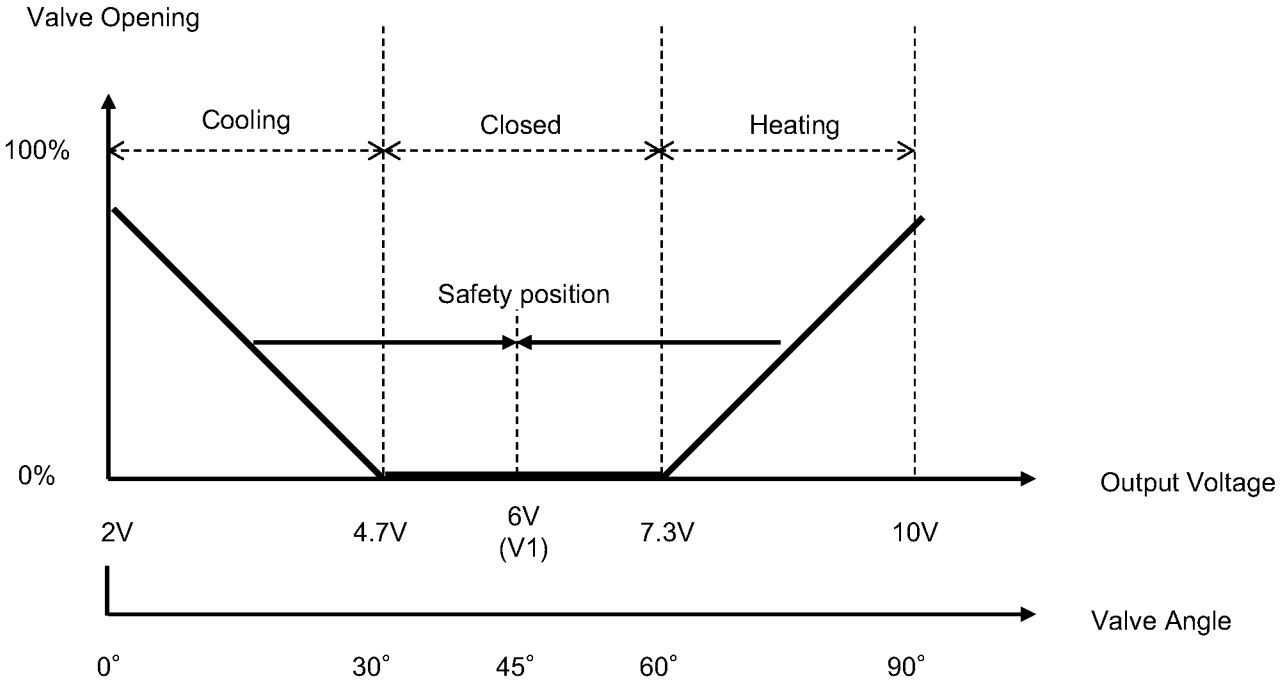
FIG. 5: an illustrative diagram showing various operating states of an HVAC system in relation to various values of the control signal.

FIG. 5 shows an illustrative diagram of various operating states of the HVAC system 1 in relation to various values of the control signal. As depicted, various values of the control signal (first horizontal axis) result in corresponding valve angles of the 6-way flow regulator 42 (shown on the second horizontal axis). In particular, the reference value V1—which is provided by the HVAC sensor device 50 and which is within a value range of the control signal (in the depicted example 6V)—corresponds to a safety position which reduces and/or prevents formation of condensation (a closed position in the depicted example).

Figure 6:
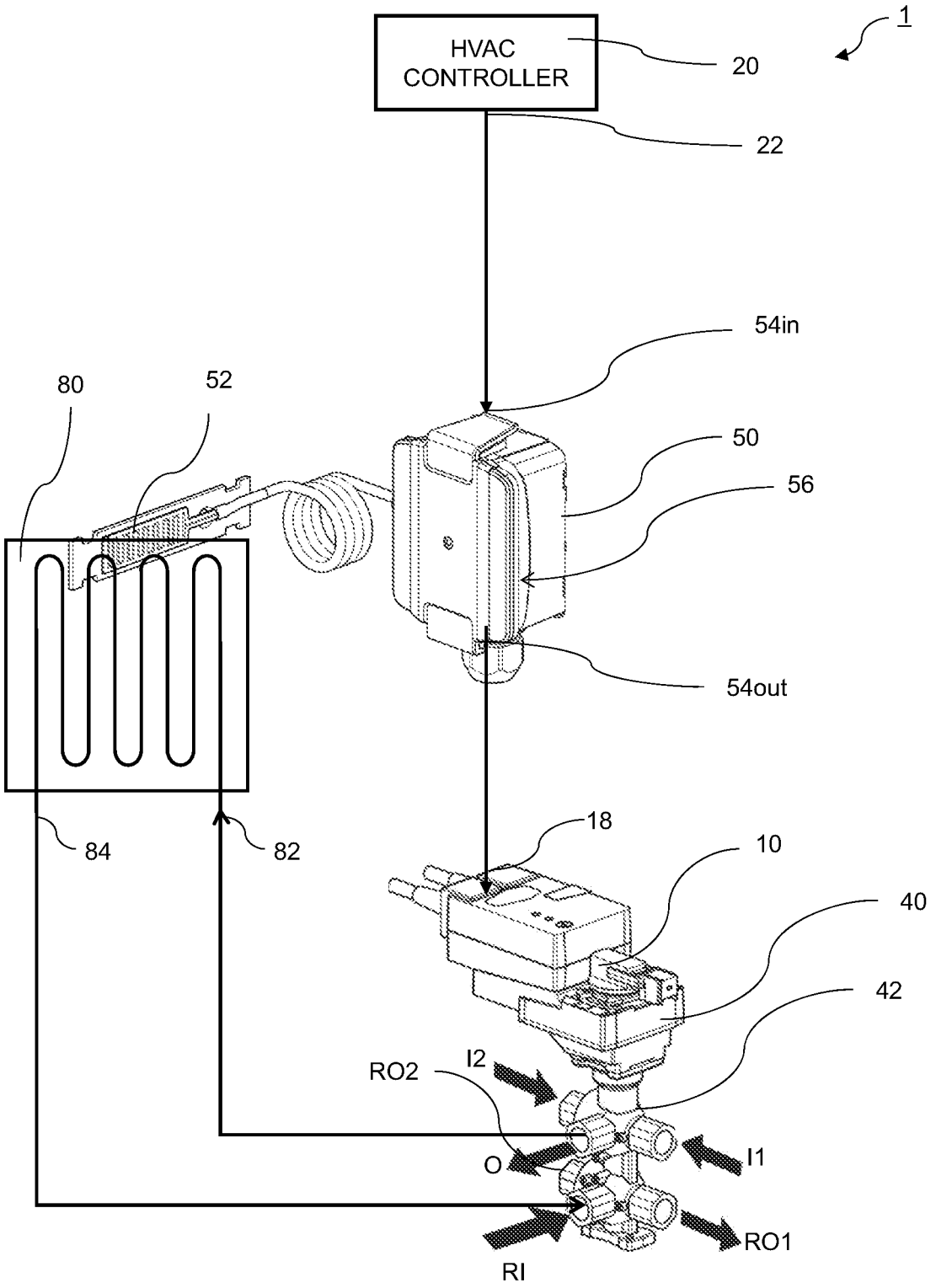
FIG. 6: a highly schematic illustration of a further embodiment of an HVAC system comprising an HVAC sensor device arranged between an HVAC controller and an HVAC actuator for controlling a 6-way flow regulator according to embodiments of the present disclosure, the 6-way flow regulator being connected to a heat exchanger.

FIG. 6 shows a highly schematic illustration of a further embodiment of an HVAC system a comprising an HVAC sensor device 50 arranged between an HVAC controller 20 and an HVAC actuator for controlling a 6-way flow regulator 42, the 6-way flow regulator being connected to a heat exchanger 80. In order for the same heat exchanger 80 to be used for both heating and cooling, a fluid input side 82 of the heat exchanger 80 is fluidly connected to the fluid output O of the 6-way flow regulator 42 and a fluid return side 84 fluidly connected to the fluid return input RI of the 6-way flow regulator 42. The first fluid input I1 of the 6-way flow regulator 42 is fluidly connected to a fluid source of a first temperature and the second fluid input I2 of the 6-way flow regulator 42 is fluidly connected to a fluid source of a second temperature, the first temperature being different from the second temperature. A sensor(s) 52 is communicatively connected to the HVAC sensor device 50 and is arranged to measure condensation on a surface of the heat exchanger 80 and/or a surface of a fluid connection between the heat exchanger 80 and the 6-way flow regulator 42. Additionally, or alternatively, the sensor(s) 52 is arranged to measure the dew-point in a vicinity of the heat exchanger 80.

Figure 7:
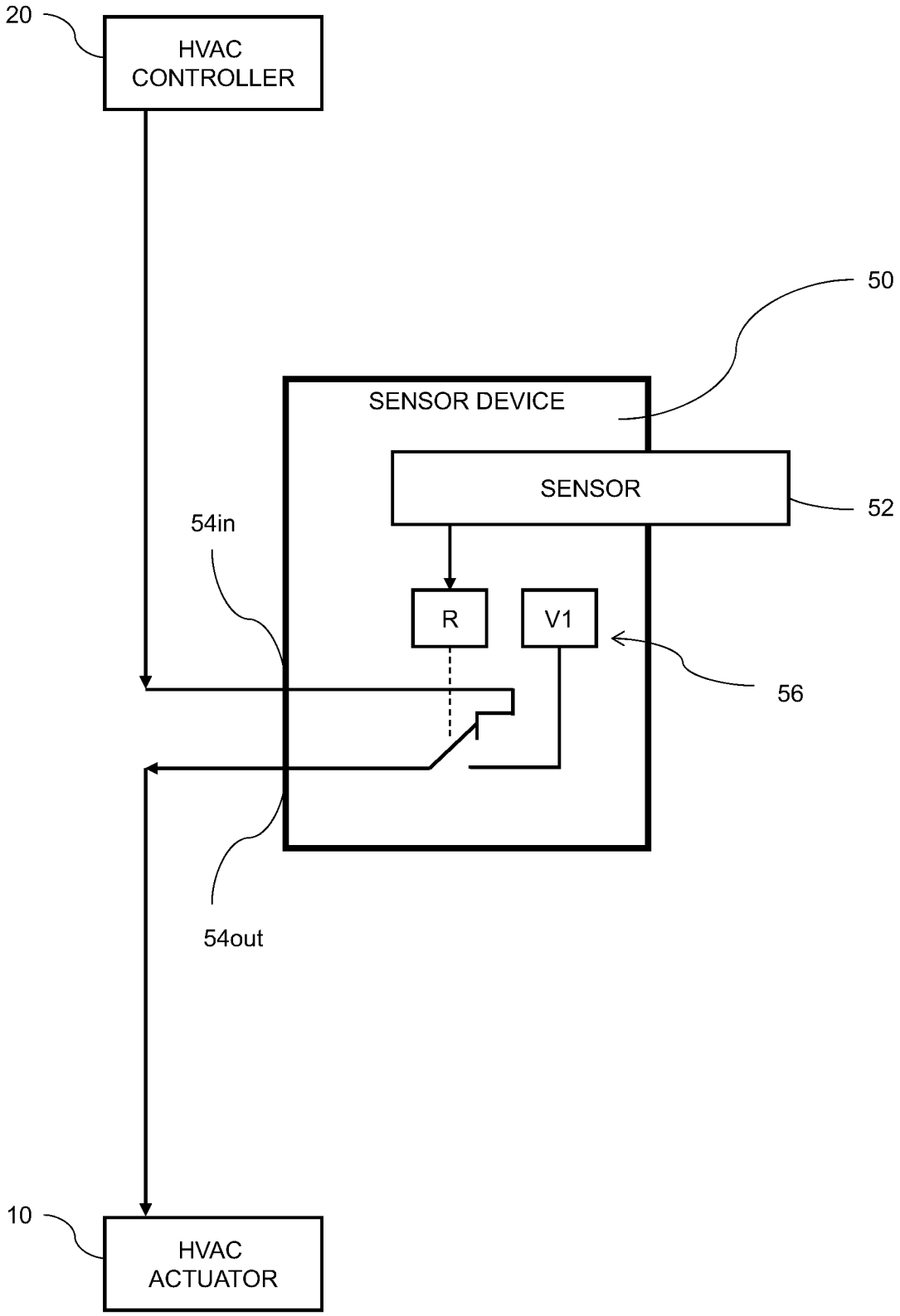
FIG. 7: a block diagram of an HVAC sensor device according to an embodiment of the present disclosure, the HVAC sensor device being arranged between an HVAC controller and an actuator of an HVAC system.

FIG. 7 shows a block diagram of an HVAC sensor device 50 according to a first embodiment of the present disclosure, the HVAC sensor device 50 being arranged between an HVAC controller and an HVAC actuator 10 of an HVAC system 1. As illustrated, the electronic circuit 56 of the HVAC sensor device 50 comprises a relay switch R configured to connect the control signal input 54in with the control signal output 54out if the sensor signal(s) indicative of condensation and/or relative humidity is within a defined range(s)). If the sensor signal(s) indicative of condensation and/or relative humidity is outside the defined range, the relay switch R connects the control signal output 54out to (a source of) the control reference value V1 (for example in the range of 4.7-7.3V).

Figure 8:
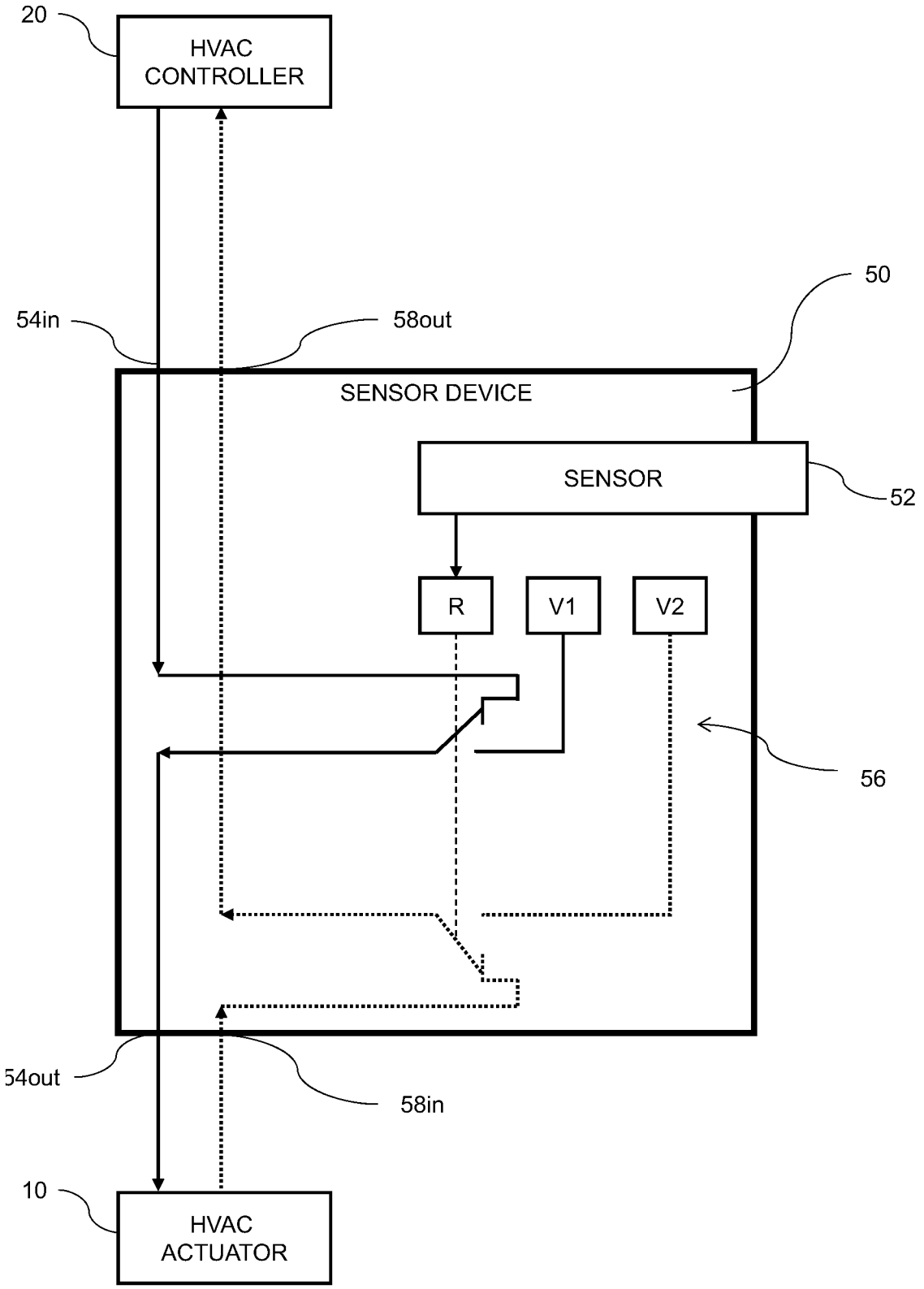
FIG. 8: a block diagram of an HVAC sensor device according to a further embodiment of the present disclosure, the HVAC sensor device being arranged between an HVAC controller and an actuator of an HVAC system.

FIG. 8 shows a block diagram of an HVAC sensor device 50 according to a further embodiment of the present disclosure, the HVAC sensor device 50 being arranged between an HVAC controller 20 and an HVAC actuator 10 of an HVAC system 1. Illustrated with dotted lines, the sensor device 50 further comprises a feedback output 58out for transmitting feedback signal(s) to the HVAC controller 20.

As illustrated, the relay switch R of the electronic circuit 56 of the HVAC sensor device 50 connects the feedback output 58out to the feedback input 58in if the sensor signal(s) indicative of condensation and/or relative humidity is within a defined range(s)). If the sensor signal(s) indicative of condensation and/or relative humidity is outside the defined range, in order for the HVAC controller(s) being aware of its control signals being overwritten, the relay switch R connects the feedback output 58out to (a source of) a feedback reference value V2. Alternatively, the relay switch R of the electronic circuit 56 of the HVAC sensor device 50 connects the feedback output 58out to a first feedback reference value V2.1 if the sensor signal(s) indicative of condensation and/or relative humidity is within a defined range(s)) and a second feedback reference value V2.2 if the sensor signal(s) indicative of condensation and/or relative humidity is outside the defined range.

Figure 9:
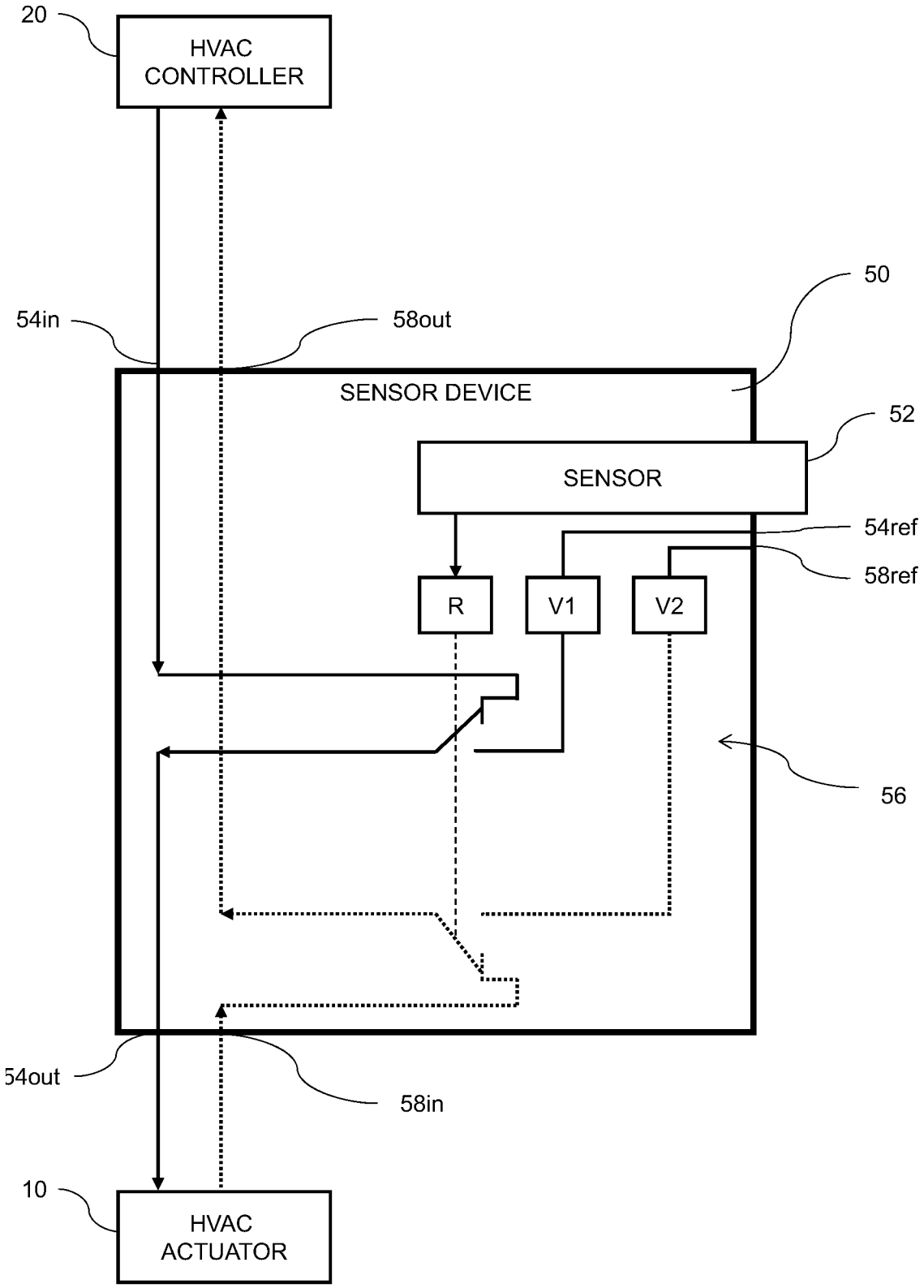
FIG. 9: a block diagram of an HVAC sensor device according to an even further embodiment of the present disclosure, the HVAC sensor device being arranged between an HVAC controller and an actuator of an HVAC system.

FIG. 9 shows a block diagram of an HVAC sensor device 50 according to an even further embodiment of the present disclosure, the HVAC sensor device 50 being arranged between an HVAC controller 20 and an HVAC actuator 10 of an HVAC system 1, wherein the control reference value V1 and/or the feedback reference value V2 is/are received by the HVAC sensor device 50 using a reference input(s) 54ref respectively a feedback reference input(s) 58ref.

According to embodiments disclosed herein, the HVAC sensor device 50 is configured to transfer at least a part of electrical power received at the control signal input 54in to the control signal output 54out. Furthermore, the HVAC sensor device 50 is configured to power the electronic circuit 56 and the sensor 52 using electrical power received at the control signal input 54in.

Figure 10:
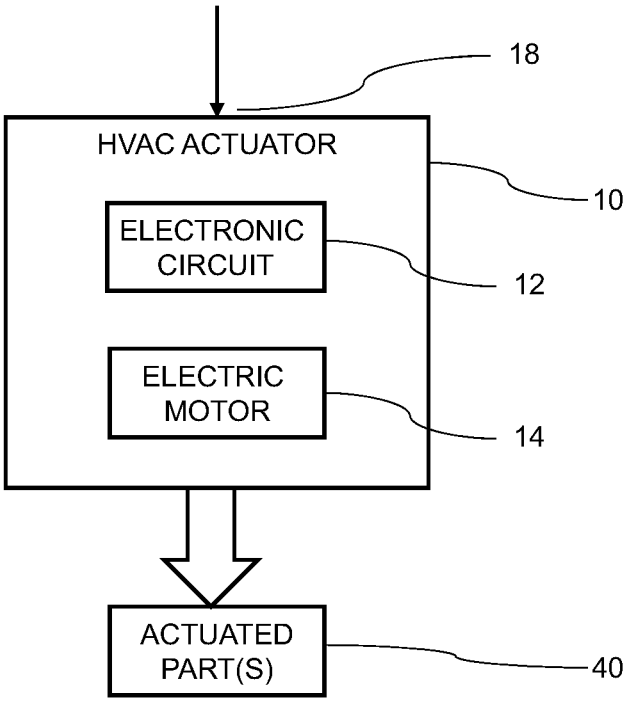
FIG. 10: a block diagram of an HVAC actuator of an HVAC system according to the present disclosure.

FIG. 10 shows a block diagram of an HVAC actuator 10 of an HVAC system 1 according to embodiments of the present disclosure. As illustrated, the HVAC actuator 10 comprises an electric motor 14 and an electronic circuit 12. The electric motor 14 is configured to move an actuated part 40 coupled to the electric motor 14. The actuated part 40 is not part of the HVAC actuator 10. The HVAC actuator 10 is configured to receive control signal(s). The electronic circuit 12 is connected to the electric motor 14 and configured to control the electric motor 14 in accordance with the control signal(s). According to embodiments of the present disclosure, the HVAC actuator 10 is configured to generate feedback signal(s) indicative of an actuated position of the actuated part 40 connected thereto.

Figure 11:
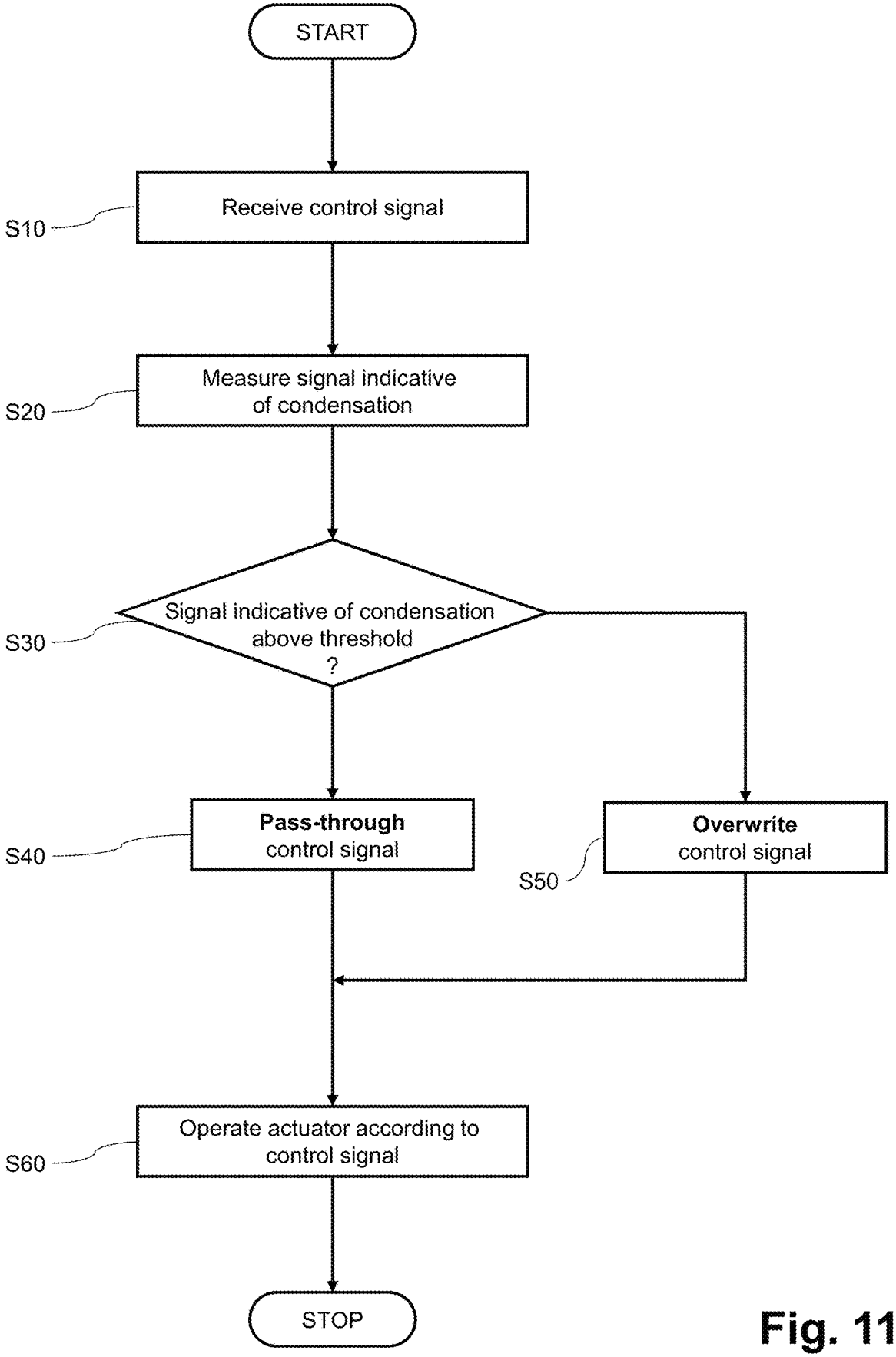
FIG. 11: an illustrative flowchart of the operation of an HVAC sensor device according to a first embodiment of the present disclosure.

FIG. 11 shows an illustrative flowchart of the operation of an HVAC sensor device 50 according to a first embodiment of the present disclosure. In a step S10, control signal(s) are received from an HVAC controller 20, at a control signal input 54in of an HVAC sensor device 50. The control signals have been generated by an HVAC controller 20 for controlling one or more HVAC actuator(s) 10.

In a step S20 condensation and/or relative humidity in the HVAC system is measured and sensor signal(s) indicative of condensation and/or relative humidity in the HVAC system is received by an electronic circuit 56 of the HVAC sensor device 50.

In a step S30, the signal(s) indicative of condensation and/or relative humidity in the HVAC system are compared—by the electronic circuit 56 of the HVAC sensor device 50—with a defined range(s).

In a step S40, the control signal(s) received at the control signal input 54in are passed through—by the electronic circuit 56 of the HVAC sensor device 50—to the control signal output 54out if the sensor signal(s) indicative of condensation and/or relative humidity is within the defined range(s).

In a step S50, the control signal(s) received at the control signal input 54in are overwritten—by the electronic circuit 56 of the HVAC sensor device 50—with a control reference value V1 and output at the control signal output 54out if the sensor signal(s) indicative of condensation and/or relative humidity is outside the defined range.

In a step S60, the HVAC actuator(s) 10 are operated according to the control signals from the HVAC sensor device 50.

Figure 12:
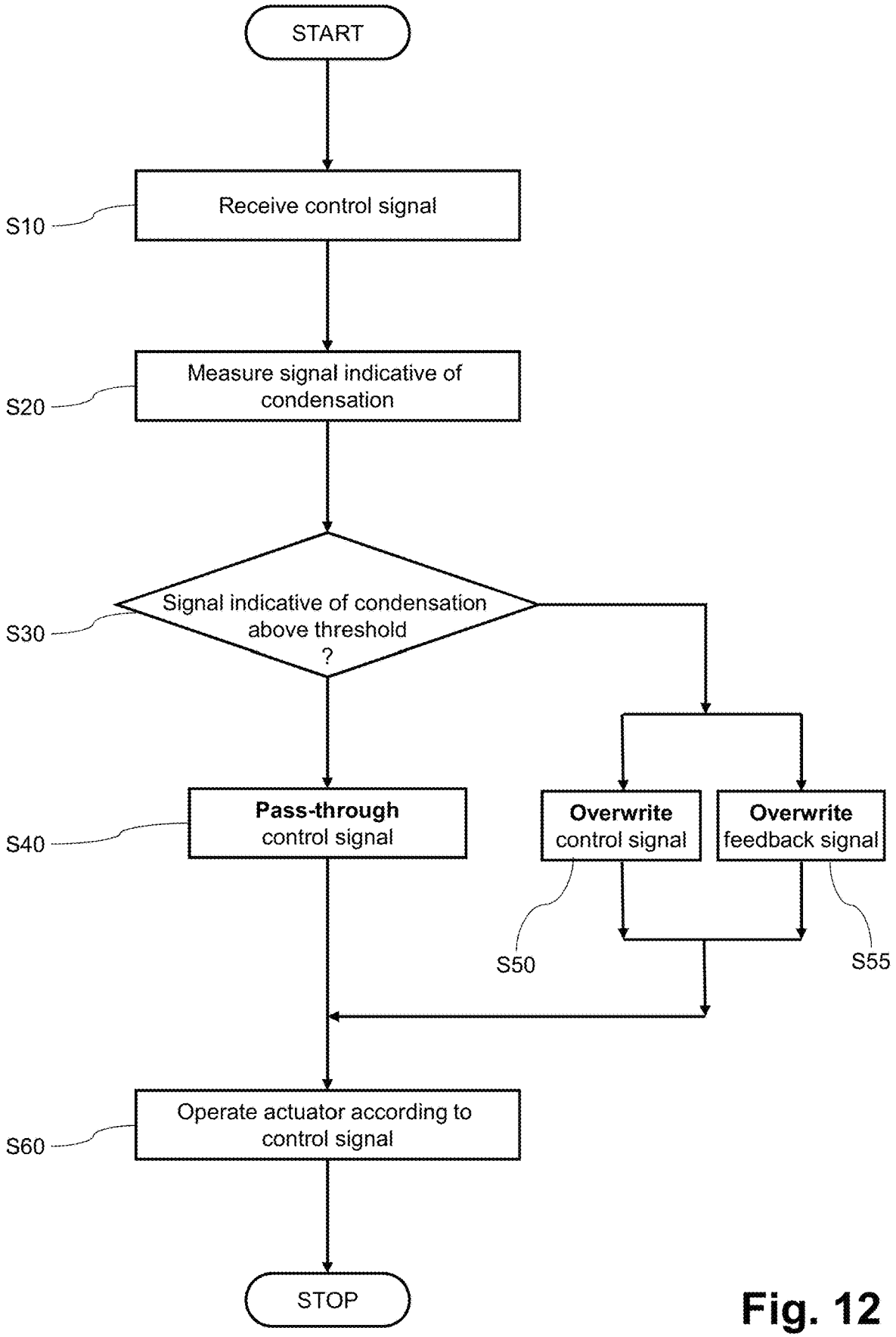
FIG. 12: an illustrative flowchart of the operation of an HVAC sensor device according to a further embodiment of the present disclosure.

FIG. 12 shows an illustrative flowchart of the operation of an HVAC sensor device 50 according to a further embodiment of the present disclosure, wherein in a step S55, a feedback signal—received at a feedback input 58in of the HVAC sensor device 50—is overwritten with a feedback reference value V2 and output at a feedback output 58out, if the sensor signal(s) indicative of condensation and/or relative humidity is outside the defined range. According to embodiments of the present disclosure, in the absence of a feedback signal, a first feedback reference value is output at the feedback output 58out, if the sensor signal(s) indicative of condensation and/or relative humidity is within the defined range.

LIST OF REFERENCE NUMERALS

HVAC actuator 10
electronic circuit (of HVAC actuator) 12
electric motor 14
communication interface (of HVAC actuator) 18
HVAC controller 20
control interface (of HVAC controller) 22
actuated part 40
6-way flow regulator 42
a first fluid input (of 6-way flow regulator) I1
a second fluid input (of 6-way flow regulator) I2
a fluid output (of 6-way flow regulator) O
a fluid return input (of 6-way flow regulator) RI
a first fluid return output (of 6-way flow regulator) RO1
a second fluid return output (of 6-way flow regulator) RO2
sensor device 50
sensor 52
control signal input 54in
control signal output 54out
reference input(s) 54ref
electronic circuit (of sensor device) 56
relay switch R
feedback signal input 58in
feedback signal output 58out
feedback reference input(s) 58ref
control reference value V1
feedback reference value V2
heat exchanger 80
fluid input side (of heat exchanger) 82
fluid return side (of heat exchanger) 84

The invention claimed is:

1. A heating, ventilating and air conditioning (HVAC) sensor device comprising:
- a control signal input for receiving, from an HVAC controller, a control signal for controlling an HVAC actuator;
- a control signal output for transmitting a control signal to the HVAC actuator; and
- an electronic circuit configured to:
  - receive a sensor signal indicative of condensation and/or indicative of relative humidity;
  - pass through the control signal received at the control signal input to the control signal output in response to the sensor signal indicative of condensation being within a defined condensation range and/or the sensor signal indicative of relative humidity is being within a defined relative humidity range, or
- overwrite the control signal received at the control signal input with a control reference value and output the overwritten control signal at the control signal output in response to the sensor signal indicative of condensation being outside the defined condensation range and/or the sensor signal indicative of relative humidity being outside the defined relative humidity range, wherein the control reference value, when received by the HVAC actuator, causes the HVAC actuator to move an actuated part to a safety position which reduces and/or prevents formation of condensation, and
- wherein the control reference value-is within a value range of the control signal received at the control signal input.

2. The HVAC sensor device according to claim 1, wherein the electronic circuit is further configured to derive the control reference value from the control signal received at the control signal input.

3. The HVAC sensor device according to claim 1, wherein the sensor signal is indicative of:
- condensation on a surface of a heat exchanger fluidly connected to the HVAC actuator; and/or
- condensation on a surface of a fluid connection to or from the HVAC actuator; and/or
- a temperature and a relative humidity of a volume of air in order to detect whether the volume of air has reached its dew point.

4. The HVAC sensor device according to claim 1, further comprising a reference input for receiving the control reference value.

5. The HVAC sensor device according to claim 1, further comprising a feedback output for transmitting a feedback signal to the HVAC controller, wherein the electronic circuit is further configured to output a feedback reference value at the feedback output in response to the sensor signal indicative of condensation being outside the defined condensation range and/or the sensor signal indicative of relative humidity being outside the defined relative humidity range.

6. The HVAC sensor device according to claim 5, further comprising a feedback input for receiving a feedback signal from the HVAC actuator, wherein the electronic circuit is further configured to pass through the feedback signal received at the feedback input to the feedback output in response to the sensor signal indicative of condensation being within the defined condensation range and/or the sensor signal indicative of relative humidity being within the defined relative humidity range.

7. The HVAC sensor device according to claim 5, further comprising a feedback reference input for receiving the feedback reference value.

8. The HVAC sensor device according to claim 1, further comprising a sensor for measurement of condensation on a surface of a heat exchanger fluidly connected to the HVAC actuator and/or on a surface of a fluid connection to or from the HVAC actuator, and/or a sensor for measurement of relative humidity of a volume of air in order to detect whether the volume of air has reached its dew point.

9. The HVAC sensor device according to claim 1, further configured to:

transfer at least a part of electrical power received at the control signal input to the control signal output; and/or power the electronic circuit and/or a sensor for the measurement of condensation and/or relative humidity using at least a part of the electrical power received at the control signal input.

10. A heating, ventilating and air conditioning (HVAC) system comprising:

the HVAC sensor device according to claim 1;

an HVAC controller configured to generate a control signal for operating the HVAC actuator at a control interface;

wherein the HVAC actuator comprises:

an electric motor configured to move the actuated part coupled to the electric motor;

an actuator electronic circuit connected to the electric motor; and a communication interface connected to the actuator electronic circuit and configured to receive the control signal for operating the HVAC actuator;

wherein the actuator electronic circuit of the HVAC actuator is configured to control the electric motor in accordance with the control signals received via the communication interface; and wherein the HVAC sensor device is arranged between the control interface of the HVAC controller and the communication interface-of the HVAC actuator.

11. The HVAC system-according to claim 10, wherein the actuated part comprises a 6-way flow regulator comprising:

a first fluid input;

a second fluid input;

a fluid output;

a fluid return input;

a first fluid return output; and a second fluid return output, wherein the HVAC actuator is configured to switch the 6-way flow regulator-between a first operating mode, a second operating mode and a third operating mode:

wherein, in the first operating mode, the 6-way flow regulator enables:

a flow of fluid from the first fluid input towards the fluid output; and a flow of fluid from the fluid return input towards the first fluid return output, wherein, in the second operating mode, the 6-way flow regulator enables:

a flow of fluid from the second fluid input towards the fluid output; and a flow of fluid from the fluid return input towards the second fluid return output, wherein, in the third operating mode, the 6-way flow regulator prevents passage of fluid between any of the first fluid input; the second fluid input; the fluid output; the fluid return input; the first fluid return output and the second fluid return output, and wherein the HVAC actuator is configured to switch the 6-way flow regulator into the third operating mode upon receipt of the control reference value.

12. The HVAC system according to claim 11, further comprising:

a heat exchanger having a fluid input side fluidly connected to the fluid output of the 6-way flow regulator and a fluid return side fluidly connected to the fluid return input of the 6-way flow regulator, a sensor configured to generate the sensor signal indicative of condensation and/or relative humidity;

wherein the first fluid input of the 6-way flow regulator is fluidly connected to a fluid source of a first temperature and the second fluid input of the 6-way flow regulator is fluidly connected to a fluid source of a second temperature, the first temperature being different from the second temperature, and wherein the sensor is configured to measure condensation on a surface and/or relative humidity in a vicinity of the heat exchanger and/or a fluid connection between the heat exchanger and the 6-way flow regulator.

13. A method comprising:

receiving from a heating, ventilating and air conditioning (HVAC) controller, at a control signal input of an HVAC sensor device, of a control signal for controlling an HVAC actuator;

receiving, by an electronic circuit of the HVAC sensor device, of a sensor signal indicative of condensation and/or indicative of relative humidity in the HVAC system;

comparing the sensor signal indicative of condensation with a defined condensation range and/or the sensor signal indicative of relative humidity with a defined relative humidity range;

passing through the control signal received at the control signal input to a control signal output in response to if the sensor signal indicative of condensation being within the defined condensation range and/or the sensor signal indicative of relative humidity is being within the defined relative humidity range; and overwriting the control signal received at the control signal input with a control reference value and outputting the overwritten control signal at the control signal output in response to the sensor signal indicative of condensation being outside the defined condensation range and/or the sensor signal indicative of relative humidity being outside the defined relative humidity range, wherein the control reference value, when received by the HVAC actuator, causes the HVAC actuator to move an actuated part to a safety position which reduces and/or prevents formation of condensation, and wherein the control reference value is within a value range of the control signal.

14. The method according to claim 13, further comprising deriving, by the electronic circuit, the control reference value from the control signal received at the control signal input.

15. The method according to claim 13, wherein the sensor signal is indicative of:

condensation on a surface of a heat exchanger fluidly connected to the HVAC actuator; and/or condensation on a surface of a fluid connection to or from the HVAC actuator; and/or a temperature and a relative humidity of a volume of air in order to detect whether the volume of air has reached its dew point.

16. The method according to claim 13, further comprising transmitting, at a feedback output of the HVAC sensor device, a feedback reference value to the HVAC controller in response to the sensor signal indicative of condensation being outside the defined condensation range and/or the sensor signal indicative of relative humidity being outside the defined relative humidity range.

17. The method according to claim 13, further comprising:

receiving a feedback signal from the HVAC actuator at a feedback input of the HVAC sensor device; and passing through the feedback signal received at the feedback input to a feedback output in response to if the sensor signal indicative of condensation being within the defined condensation range and/or the sensor signal indicative of relative humidity being within the defined relative humidity range.

18. The method according to claim 13 further comprising:

transferring at least a part of electrical power received at the control signal input to the control signal output; and/or powering the electronic circuit of the HVAC sensor device and/or a sensor for measurement of condensation and/or relative humidity using at least a part of the electrical power received at the control signal input.

* * * * *